United States Patent [19]

Albanese

[11] 4,141,697

[45] Feb. 27, 1979

[54] ALKALINE TREATED MOLECULAR SIEVES TO INCREASE COLLECTION EFFICIENCY OF ELECTROSTATIC PRECIPITATOR

[75] Inventor: Vincent M. Albanese, Lockport, Ill.

[73] Assignee: Nalco Chemical Company, Oak Brook, Ill.

[21] Appl. No.: 868,007

[22] Filed: Jan. 9, 1978

[51] Int. Cl.[2] ..... B03C 1/00

[52] U.S. Cl. ..... 55/5; 55/75

[58] Field of Search ..... 55/5, 75, 73; 423/215.5

[56] References Cited

U.S. PATENT DOCUMENTS

| | | | |
|---|---|---|---|
| 1,446,778 | 2/1923 | Witte | 55/5 |
| 2,882,244 | 4/1959 | Milton | 55/75 |
| 3,078,641 | 2/1963 | Milton | 55/75 |
| 3,886,261 | 5/1975 | Libutti | 55/73 |

FOREIGN PATENT DOCUMENTS

| | | | |
|---|---|---|---|
| 389822 | 11/1973 | U.S.S.R. | 55/73 |

OTHER PUBLICATIONS

White et al - Collection of Fly Ash - Research Corp., Bound Brook, N. J., published by ASME, pp. 873-880.

*Primary Examiner*—Bernard Nozick
*Attorney, Agent, or Firm*—John G. Premo; Robert A. Miller

[57] ABSTRACT

A method for the electrostatic precipitation of dust particles entrained in a gas stream which comprises adding predetermined amounts of a molecular sieve into the particle-laden gas stream in a location preceding the precipitation apparatus where the gas is at an elevated temperature.

2 Claims, No Drawings

ALKALINE TREATED MOLECULAR SIEVES TO INCREASE COLLECTION EFFICIENCY OF ELECTROSTATIC PRECIPITATOR

INTRODUCTION

DESCRIPTION OF THE PRIOR ART

A conventional way of separating dust particles from a gas stream in which the particles are entrained is by the use of an electrostatic precipitator. This apparatus utilizes the corona discharge effect, i.e., the ionization of the particles by passing them through an ionization field established by a plurality of discharge electrode wires suspended in a parallel plane with a grounded collecting electrode plate. The ionized particles are attracted to the collector plate from which they may be removed by vibrating or rapping the plate. Examples of this type precipitator are found in Cummings' U.S. Pat. No. 3,109,720 and Pennington U.S. Pat. No. 3,030,753.

Dust particles have different characteristics depending upon their source. One characteristic is resistivity which is measured in ohm-centimeters. For example, where the source of particles is a coal-fired boiler, there is usually a predictable relationship between the type of coal burned and the resistivity of the particles. Typically, low sulphur coal, i.e. less than 1% sulphur, produces particles having high resistivity, i.e. $10^{+13}$ ohm-centimeters resistance; coal with 3 - 4% sulphur produces particles having $10^{+8}$–$10^{+10}$ ohm-cm. resistance; and, poorly combustible coal produces particles having $10^{+4}$–$10^{+5}$ ohm-cm resistance.

It has been found that most efficient separation or precipitation of the particles occurs when their resistivity is about $10^{+8}$–$10^{+10}$ ohm-centimeters. When the resistivity is higher than this, the precipitation process is encumbered because the particles tend to hold their charge; particles collected on the plate in a layer tend to remain negatively charged and particles subsequently charged in the gas stream are not attracted to the plate with a resultant loss of efficiency. Conversely, when the resistivity is lower than this, the low resistivity particles lose their charge rapidly upon contact withe collector plate thereby being difficult to retain thereon; re-entrainment then occurs with a resultant loss of efficiency. However, when the particles are of the preferred resistivity, a balance is achieved between the tendency to have either overcharged or undercharged particles with a resultant increase in precipitation efficiency. Thus, the problem which existed until now was to provide a means for reducing the resistivity of high-resistivity particles and increasing the resistivity of low-resistivity particles.

THE INVENTION

The electrostatic removal of high-resistivity particles entrained in a gas stream can be improved by the addition to such gas stream of pre-selected amounts of a molecular sieve.

Dosage

The amount of the molecular sieve that is effective in decreasing the resistivity of the dust particles may vary. Generally it is used in an amount ranging from 0.1 up to about 6 weight persent based on the weight of the particles present in the gas stream. In a preferred embodiment, the dosage ranges between 0.5–3% by weight.

A convenient method of dosing the molecular sieve is to add 45–1250 grams per metric ton of coal burned to form the gas.

Application Temperature

Most large coal-fired boilers are composed of a number of regions. These regions, starting with the combustion flame and ending with the electrostatic precipitator which, in most instances, is located prior to the exhaust gas stack, form a series of progressively cooler gas temperature zones. For purpose of simplification, these zones and their respective temperatures are set forth below in a simplified manner:

| Location | Temperature |
|---|---|
| In the flame - | 2500 – 3500° F. |
| In the furnace-radiant section- | 2000 – 2500° F. |
| After super heater - | 1000 – 1600° F. |
| After economizer - | 500 – 750° F. |
| After air heater - | 250 – 350° F. |
| Up the stack - | 250 – 350° F. |

The molecular sieve is added to the gas stream at a temperature in excess of about 250° but, preferably, at a temperature greater than 600° F. In certain instances, they can be employed at temperatures as high as 1800° F.

The Molecular Sieve

The molecular sieves used in the practice of the invention have the formula:

$$M_{2/n}O:Al_2O_3:wSiO_2:YH_2O$$

wherein M represents at least one cation which balances the electrovalence of the tetrahedra, n represents the valence of the cation, w the moles of $SiO_2$ and Y the moles of $H_2O$.

These sieves are well known and are described in detail in U.S. Pat. No. 3,140,235, the disclosure of which is incorporated herein by reference. A preferred sieve is zeolite X which is described in detail in U.S. Pat. No. 2,882,244. The disclosure of this patent is incorporated by reference. A commercial species of Sieve X is sold by Linde under the trade designation, Molecular Sieve 13X. It has the following formula:

$$Na_{86}([AlO_2]_{86}[SiO_2]_{106}).XH_2O$$

Evaluation of the Invention

To evaluate the effectiveness of the treatment chemical as a gas treating aid to improve electrostatic precipitator performance, the following test method was used.

ASME Power Test Code 28, which is described in the December, 1972 issue of *Power Engineering* in an article by W. E. Archer, was one test method utilized for determining fly ash bulk electrical resistivity. Briefly, this test entailed:

a. placing a treated ash sample in a conductivity cell maintained at approximately 300° F. and at about 8% humidity;

b. lowering an electrode onto the surface of the ash sample;

c. applying 2 kv/cm at a constant field to the cell and measuring current through the ash sample;

d. calculating the resistivity of the ash sample by relying on the voltage and current readings;

e. applying increased voltages to the cell while observing the current through the ash sample until electrical breakdown of the sample layer occurred; and f. calculating resistivity by relying on the voltage and current readings in the range of 85–95% of the breakdown voltage.

The treated ash sample was prepared by slurrying the fly ash in a small amount of water, adding Molecular Sieve 13X.

At 5% by weight based on the weight of the fly ash decreased the resistivity from $10^{13}$ ohms-cm. to $3 \times 10^{10}$ ohms-cm.

Having thus described my invention, it is claimed as follows:

1. A method of improving the conductivity of particles entrained in a stream of particle-laden gas formed by the burning of coal, which particles are collected by an electrostatic precipitator which comprises treating said gas containing the particles prior to contact with the electrostatic precipitator at a temperature not greater than about 1800° F. with a amount of a molecular sieve sufficient to decrease resistivity to $10^{+8}$–$10^{+10}$ ohm-cm. having the formula:

$$M_{2/w}O:Al_2O_3:wSiO_2:YH_2O$$

wherein M represents at least one cation which balances the electrovalence of the tetrahedra, n represents the valence of the cation, w the moles of $SiO_2$ and Y the moles of $H_2O$ and then passing the gas to the electrostatic precipitator.

2. The method of claim 1 where the molecular sieve is Sieve X.

* * * * *